United States Patent [19]

Ghaly

[11] Patent Number: 4,685,710

[45] Date of Patent: Aug. 11, 1987

[54] CLAMPING DEVICE

[76] Inventor: Azmy W. Ghaly, 2122 24 Ave. S., Minneapolis, Minn. 55406

[21] Appl. No.: 615,348

[22] Filed: May 30, 1984

[51] Int. Cl.[4] ..... E05C 5/02

[52] U.S. Cl. ..... 292/67

[58] Field of Search ..... 292/63-68, 292/206, 212, 195, 256, 256.73, 256.75; 267/177, 178, 175

[56] References Cited

U.S. PATENT DOCUMENTS

| | | | |
|---|---|---|---|
| 973,641 | 10/1910 | Dysart | 267/177 |
| 2,269,264 | 1/1942 | Haim | 292/212 X |
| 2,603,739 | 7/1952 | Steen | 292/256 X |
| 2,860,904 | 11/1958 | Barry et al. | 292/206 X |
| 2,981,560 | 4/1961 | Wehner | 292/67 X |
| 3,014,711 | 12/1961 | Delvaux | 267/178 |
| 3,151,903 | 10/1964 | Effner | 292/256.75 |
| 3,978,615 | 9/1976 | Kagoura | 267/177 X |
| 4,112,960 | 9/1978 | Hermanns | 267/175 X |
| 4,465,328 | 8/1984 | Tihanyi et al. | 292/67 X |

*Primary Examiner*—Richard E. Moore

[57] ABSTRACT

A clamping device, utilizing an L-shaped latch member and one or two coil springs inside a housing, so that when the housing is rotated, it carries the bigger spring and the smaller spring (in case two springs are used) and causes the convolutions of one or both springs to feed under a pin which is firmly attached perpendicular into the round stem of the L-shaped latch, inside the housing. By turning the housing relative to this stem of the L-shaped latch, the springs are forced to feed more of their convolutions under the pin of the stem, until all convolutions of one or both springs under the pin are in a solid compressed form, which means that the L-shaped latch has been drawn closer and tight with the base of the housing. This constitutes a useful clamping device to hold two panels together, such as a door to its enclosure.

4 Claims, 25 Drawing Figures

CLAMPING DEVICE

BACKGROUND OF THE INVENTION (1) Field of the Invention:

This clamping device relates to a door or panel fastener. It is simple in design, easy to mount on the panel door because it only requries a single round hole in the door. It is less expensive to make and install. After the latch has been turned in latching position, it can be drawn up for a firm engagement by compressing a spring to a solid condition which insures beyond doubt the firmness of latching, which is a great advantage compared to other, expensive conventional latches. It does not need welding, riveting, or bolting to the door. Only a round hole in the door is required to be drilled. When the clamping device is installed in the hole in the door, it has only a small part, which is the L shape member of the latch, extending into the inside of the door. This feature makes the device adaptable to be used to lock doors in pneumatic systems or pipes to satisfy the sanitation conditions required in food or pharmaceutical conveying systems where inspection and chuck doors are required. When the conveying tube system becomes chucked because of a fault with the system, which often happens—the operator or maintenance person must quickly open the door to relieve the chucking condition. This latching invention is sanitary and can be opened quickly. The parts of this invention are simple stock or shelf parts available cheaply everywhere. Many designers will use it because of its merits and advantages, which can be summed up as: simplicity, low cost, sanitariness, easy mounting when one hole is drilled in the door, ease of operation, and reliability because it latches firmly when the spring is compressed as a solid. Also, except for the L shape latch part, the spring, and the pins which are made of steel or aluminum alloys, all other parts can be made of any convenient material, including plastics in order to further reduce costs and to give it the attractive colors available in plastic. When the housing of the device is made from plastics, all the features of the housing are made at one time as the part is being molded.

(2) Background Art:

There are many different designs of door latches in the market which are lacking in sanitation requirements; they are also expensive to mount—using welds, rivets, or other elaborate ways of mounting; and most of the L shaped conventional latches are made of expensive parts which require machining, such as threads in metallic parts. Today, do-it-yourself and cost reduction concepts in design and manufacturing cannot be attained with conventional door latches. For these reasons new designs and new actions are needed to fulfill today's requirements. My invention—which is simple, cheap to make and install, and sanitary for food industries—is a door latch which many designers are looking for.

SUMMARY

My invention is based on new action in a type of latch using the L-shape latch which is rotated to firmly hold a door tight to its enclosure. This tremendous latching force is attained by compressing a spring under a pin in a solid compressed condition. Also there is a lever which, when pressed down, locks the device against loosening. The housing of the device can be molded from any material, including plastics, and does not require any machining. It is cheap to manufacture and easy to install when one round hole is made in the door into which the L-shaped latch is to be installed. It is also a sanitary door latch suitable for the food and pharmaceutical industries. When the latch is fastened tight, it seals any opening around its L-shape stem and the door surface to prevent any possible contamination from the outside to the inside through the mounting hole in the door.

DETAILED DESCRIPTION OF THE DRAWINGS

Figure 5A:
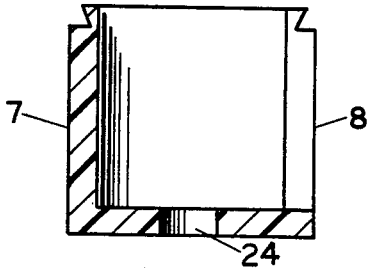
Figure 12B:
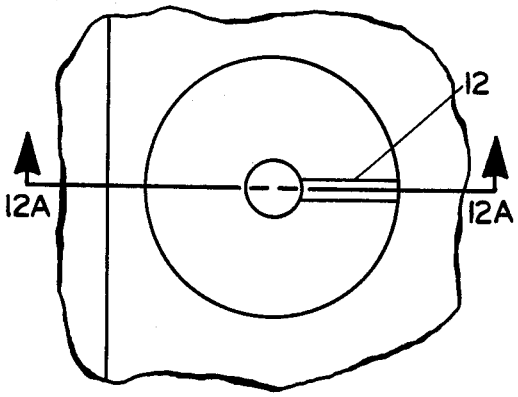
FIGS. 12A and 12B illustrate a sectional view and top view of the whole assembly of the L-shaped clamping device respectively.
Figure 12A:
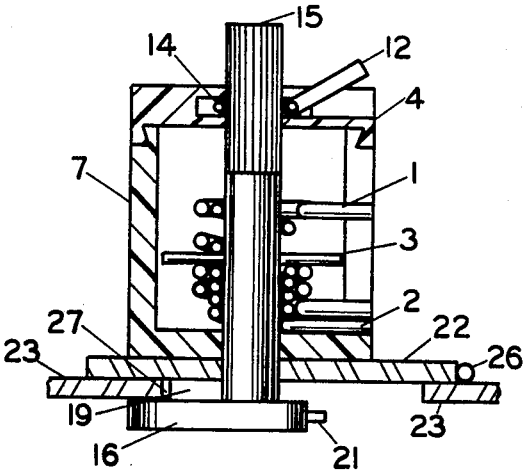

Illustrated in FIG. 12A is an L-shaped latch assembly in latched or engaged position. A rotatable L-shaped latch member 15 is disposed within a housing 7 defined by closed bottom wall, a circular side wall and an open top. FIG. 5A shows the closed bottom wall with a hole 24 and a circular side wall with a longitudinal slot 8.

Figure 4B:
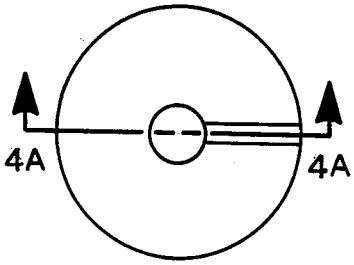
FIGS. 4A and 4B illustrate top and cross sectional views of a cover respectively.
Figure 4A:
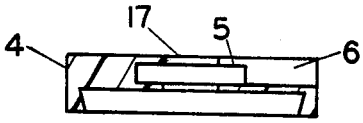
Figure 11B:
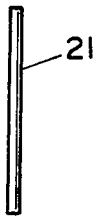
FIGS. 11A and 11B illustrate bottom and front views respectively of a pin member of an L-shaped latch member shown in FIGS. 8A and 8B.
Figure 11A:
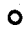
Figure 10B:
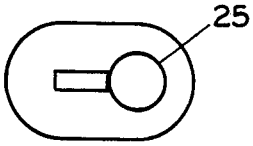
FIGS. 10A, 10B and 10C illustrate side, top views, and end view respectively of the feet member of an L-shaped latch member shown in FIGS. 8A and 8B.
Figure 10C:
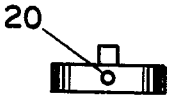
Figure 10A:
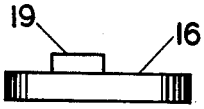
Figure 6B:
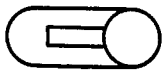
FIGS. 6A and 6B illustrate side and top views of one piece L-shaped latch member.
Figure 7A:
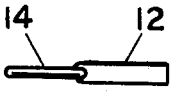
FIGS. 7A and 7B illustrate front and bottom views of an assembly of two pieces, a lever 12 and a spring ring 14.
Figure 7B:
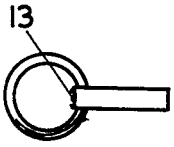
Figure 6A:
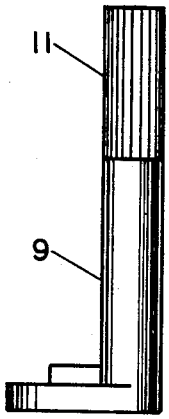
Figure 8B:
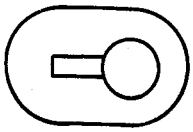
FIGS. 8A and 8B illustrate side and top views of a modification of an L-shaped latch member involving three pieces; foot 16, stem 15 and pin 21.
Figure 9B:
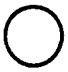
FIGS. 9A and 9B illustrate side and top views of a stem member of an L-shaped latch member shown in FIGS. 8A and 8B.
Figures 8A, 9A:
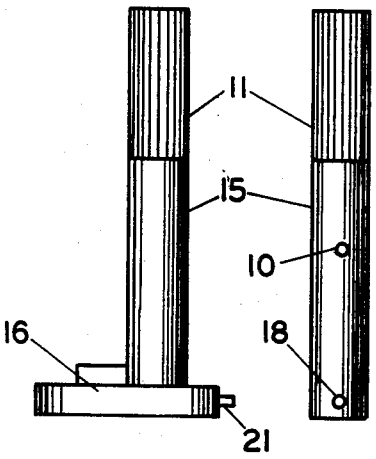

A cover or cup 4 is provided for closing the top of housing 7 and is snap fit onto the housing. FIG. 4A shows the cover in detail which includes a hole 17 through which a stem 11 of an L-shaped latch member 15 extends. Also shown are a concentric inner groove 5 and a radial groove 6 on the cover 4 for housing a spring ring 14 and lock lever 12 respectively. The spring and lock lever are best shown in FIGS. 7A and 7B. FIG. 7B shows teeth like end 13 of lever 12. FIGS. 6A and 6B illustrate side and top views of the L-shaped latch member made into one piece. FIGS. 8A and 8B showing side and top views of an assembly of the L-shaped latch member made of three pieces, stem 15 illustrated in FIGS. 9A and 9B, feet 16 illustrated in FIG. 10A, 10B and 10C, and a pin 21 illustrated in FIGS. 11A and 11B. The upper portion of stem 15 has grooves 11. Also the grooves 11 are illustrated in the one piece L-shaped latch in FIG. 6A.

Figure 2B:
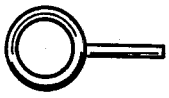
FIGS. 2A and 2B illustrate side and top views of a small coil spring.
Figure 2A:
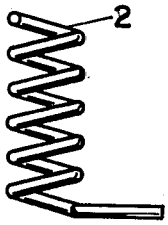
Figure 1B:
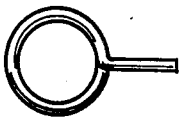
FIGS. 1A and 1B illustrate side and top views of a large coil spring.
Figure 1A:
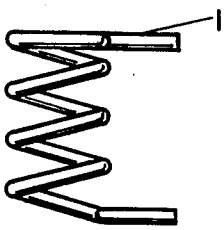
Figure 3A:
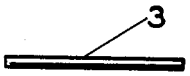
FIGS. 3A and 3B illustrate front and side views of a steel pin.
Figure 3B:
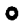
Figure 5B:
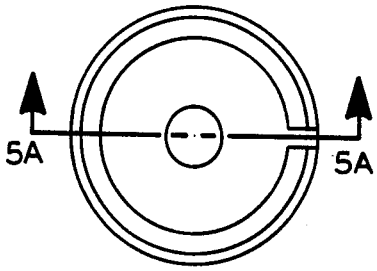
FIGS. 5A and 5B show a cross-sectional side view and top view of a housing respectively.

FIGS. 1A and 1B show a large spring 1 and FIGS. 2A and 2B show a small spring 2. Springs 1 and 2 are disposed within housing 7 and around the L-shaped latch member 15. The springs include a plurality of convolutions or turns and also include ends which are disposed within the longitudinal slot 8 of housing 7. FIGS. 3A and 3B show a pin 3 force fit into a bore 10 within the L-shaped latch member 15 and extending through the convolutions or turns of spring 1 and 2 inside housing 7 as illustrated in FIG. 12A. Also FIG. 12A shows a door 22 hinged by hinge 26 to its enclosure 23. In door 22 is a hole through it passes the L-shaped latch member 15. FIG. 12A shows the L-shaped latch assembly in latching or engaged position in which one or the two springs' convolutions under pin 3 are compressed solid to hold door 22 tight to its enclosure 23.

How the L-shaped latch is assembled in a door panel of an enclosure

Reference FIG. 12A (1) Insert the L-shaped latch member 15 in a hole which is made in a door 22.

(2) Position the housing 7 over the hole in door 22, then insert the small spring 2 and the large spring 1 concentric with the stem 11 of the L-shaped latch. The straight free ends of springs 1 or 2 are extended through the longitudinal slot 8 of housing 7.

(3) Insert push fit pin 3 into its hole 10 in the L-shaped latch 15 so that when member 15 is rotated relative to housing 7, pin 3 rotates with 15 inside housing 7.

(4) Insert the assembly of spring ring 14 and lever 12 into the cover 4.

(5) Insert cover 4 press fit into its groove in housing 7 provided member 15 is located through spring ring 14 and in center of cover 4. When cover 4 is pressed into its groove in housing 7, it holds tight with housing 7 as an integral part.

How does the L-shaped latch assembly or device work?

Reference FIG. 12A (1) Rotate stem 15 so the foot 16 is under enclosure 23 and the highest portion of foot 16 is inserted in a notched groove 19 in enclosure 23, which keeps foot 16 in this position while rotating the housing 7 in the correct direction to feed more convolutions of springs 1 or 2 under pin 3 till all convolutions of springs 1 or 2 under pin 3 are in a compressed solid condition which means that foot 19 of L-shaped latch is holding the door 22 tight to its enclosure 23. Finally press lever 12 into its groove in cover 4. The open end spring ring 14 is now pulling the teethed end of lever 12 in tight contact with the matching teeth 11 of L-shaped latch member 15, locking the latching device against sudden release in case of vibrations.

Notes:

(1) The small spring 2 can be deleted to save costs.

(2) In FIG. 12A the L-shaped latch is of 3 pieces, 16, 21 and 15, assembled together. One can use as option the equivalent made of one piece of L-shaped latch as shown in FIGS. 6A and 6B. The use of the 3 pieces L-shaped latch 15, 16 and 21 gives the original manufacturer the advantage of providing a subassembly that contains housing 7, stem 15, springs 1 and 2, pin 3, ring spring 14 and lever 12 and cover 4 with two separate pieces which are feet 16 and pin 21 in order to ease installation of the L-shaped latching device by unskilled labor at final assembly.

(3) It is important to distinguish this L-shaped latching device from all other L-shaped latching conventional devices which rely on the spring to exert a latching force either by tension or compression. In my L-shaped latching device, the spring is used as a variable-length solid spacer to insure positive solid tight latching force, which is an original new concept. Also in my L-shaped latching device, its latching force is independent of the spring strength or action used in the other conventional L-shaped latching devices.

(4) My L-shaped latching device is unique and reliable, can be small in size, but has tremendous latching force. It has broader range of applications. In addition, my latching device is simple and less expensive and does not rely on conventional expensive features such as bolts, threads and nuts which are used with conventional latching devices. Also, as said before, my latching device is of sanitary design.

How to release the L-shaped latching device to open the door:

Reference FIG. 12

(1) Push lever 12 to rotate upward freeing 15.

(2) Rotate housing 7 in the opposite direction in order to cause the springs 1 or 2 to rotate relative to 15 releasing the solid compressed portion of springs 1 or 2 under pin 3.

(3) When the portion of springs 1 or 2 under pin 3 are not in solid compression, one can press on 15 and in the meantime rotate 15 away from holding against 23. Pull 7 to swing open the door 22.

I claim:

1. A holding device comprising:

a cylindrical housing defined by a closed bottom wall, a circular side wall and an open top, said bottom wall having a hold disposed therein;

a cover for closing the top of said housing, said cover including a hole aligned with said bottom wall hole; an L-shaped latch member comprising a stem extending through said aligned holes, said stem including a latch portion disposed at one end thereof outside of said housing, said stem also including a handle portion at the opposite end thereof outside of said cover for rotating the latch member to latched and unlatched positions; a first coil spring disposed around said stem and extending axially through said housing, said spring comprising a lower end, and upper end and a plurality of convolutions between said ends, said housing including a longitudinal slot within said circular side wall through which said upper and lower ends extend, said stem including a diametrically disposed hole through which a pin extends, said pin also extending through the convolutions of the coil spring; whereby, rotation of said housing draws the latch portion towards said housing as successive convolutions of said spring are moved beneath said pin.

2. A holding device as claimed in claim 1 further comprising a ring disposed within a circular groove in said cover and a lock lever pivotably disposed on the ring, said lock lever pivotably disposed within a radial groove in said cover for engaging a set of teeth disposed around said handle portion of said stem to lock the stem within the housing.

3. A holding device as claimed in claim 2 further comprising in combination therewith:

a door having a hole in an inner surface of said door, said stem disposed through said hole in said door: an enclosure panel pivotably supporting said door, said latch portion engaging said enclosure panel to latch said door shut against said panel; whereby said housing may be rotated to draw the latch portion towards said housing and draw said door against said panel in a tightly clamped engagement.

4. A holding device as claimed in claim 2 further comprising a second coil spring having a lower end and a plurality of convolutions extending from said lower end, said second coil spring disposed concentrically within said first coil spring and disposed around said stem, said lower end of said second spring disposed within the longitudinal slot of said housing and said pin is disposed through the convolutions of said second coil spring whereby rotation of said housing draws the latch portion towards said housing as successive convolution of said first and second coil springs are moved beneath said pin, and the holding device attains maximum holding force when the convolutions of one or the two springs are compressed solid beneath said pin.

* * * * *